United States Patent [19]

Burell et al.

[11] Patent Number: 4,644,715

[45] Date of Patent: Feb. 24, 1987

[54] SOIL EXCAVATING SLEEVE

[75] Inventors: John A. Burell; Joseph Mason, both of Tucson, Ariz.

[73] Assignee: Loadmaster Systems, Inc., Tucson, Ariz.

[21] Appl. No.: 806,640

[22] Filed: Dec. 9, 1985

[51] Int. Cl.[4] ..... E02D 27/42

[52] U.S. Cl. ..... 52/170; 52/514; 175/262

[58] Field of Search ..... 52/514, 516, 170, 728, 52/155, 165; 405/216, 232, 243; 175/308, 312, 262

[56] References Cited

U.S. PATENT DOCUMENTS

| | | | |
|---|---|---|---|
| 108,814 | 11/1870 | Moseley . | |
| 1,157,444 | 10/1915 | Stewart . | |
| 2,133,563 | 10/1938 | Parks . | |
| 2,203,881 | 6/1940 | Schwab . | |
| 2,237,383 | 4/1981 | Agostineto . | |
| 2,305,200 | 12/1942 | Sitton . | |
| 2,775,428 | 12/1956 | Monthan . | |
| 2,860,854 | 11/1958 | Wilcox | 175/308 X |
| 2,896,729 | 7/1959 | Brecklin . | |
| 2,897,553 | 8/1959 | Gorrow | 52/722 |
| 2,942,501 | 6/1960 | Killio . | |
| 3,210,867 | 10/1965 | Daniels . | |
| 3,217,816 | 11/1965 | Boyer . | |
| 3,307,643 | 3/1967 | Ferri . | |
| 3,382,939 | 5/1968 | Lendon . | |
| 3,385,070 | 5/1968 | Jackson . | |
| 3,848,687 | 11/1974 | Funakubo . | |

FOREIGN PATENT DOCUMENTS

| | | |
|---|---|---|
| 86047 | 8/1957 | Netherlands . |
| 233372 | 1/1924 | United Kingdom . |

*Primary Examiner*—Carl D. Friedman

*Attorney, Agent, or Firm*—J. Michael McClanahan

[57] ABSTRACT

A soil excavating and utility pole securing sleeve is disclosed which will, when rotated around a standing utility pole, excavate an annulus of soil between the pole and the interior of the sleeve. The excavating sleeve defines an elongated hollow cylinder having teeth and inwardly bent excavating doors or flaps at one end which moves the soil between the utility pole and the sleeve out the door or flap and compacts the soil into the earth surrounding the sleeve. The sleeve is rotated into the ground around the utility pole for half its length, left there, and the evacuated annulus of soil then filled with a mixture of epoxy, resin, fungicide, and aggregate, allowed to cure and harden in order that the utility pole, the filling, and the sleeve become one single structure with a strength greater than that possessed by the original utility pole when new.

19 Claims, 7 Drawing Figures

SOIL EXCAVATING SLEEVE

BACKGROUND OF THE INVENTION

There has developed in recent years different methods to extend the lifetime of wood telephone and power line poles by surrounding the pole at the ground level with a protective sleeve which holds the pole in a secured arrangement so that the pole may be continued in service. It is common for these utility poles, prior to placement in the ground, to be treated with a preservative, such as creosote. Creosote protects the pole against termites, wood rot, and other elements in the soil which are destructive to the integrity of the wood of utility poles, however, after a period of years, the creosote protection wains and the elements, both in the earth and in the air, begin to attack and rot and decay the wood of the pole. In most cases, and depending upon the type of soil that the pole is resting in, the pole will experience its most severe rot and decay at or just below the ground level. Pole decay generally starts immediately below ground line, works down to an expected depth of approximately 18 inches, and up the pole at a slow rate.

In the past, the process has been to replace the pole with a new pole, or to saw the existing pole off near the ground line and place a second pole into the ground nearby, then piggy-back the old pole to the stub of the new pole sticking out of the ground with strapping. As mentioned above, there has been progress in placing split sleeves around the telephone poles whereby a circular area around the pole is dug out by hand, the split sleeve assembled around the pole, and then the volume evacuated outside the new sleeve filled in. The sleeve surrounding the pole may engage the pole in a tight or compression configuration, or the sleeve may have an annulus between the outer diameter of the pole and the inner diameter of the sleeve, the annulus then filled with a mixture of sand, soil, aggragate, and chemicals to preserve the pole. In such case, the usual procedure is to emplace the sleeve approximately 3 feet below the soil level (past the point of usual decay), with the sleeve rising into the air another 3 feet (also past the area of usual decay). The portion of the pole below the 3 foot depth has usually maintained its integrity, as well as the portion of the pole above the 3 foot height above ground level.

The rule of thumb for pole emplacement is that approximately 1/5th. of the length of the pole is buried into the ground, although this general formula may be varied depending on the type of ground encountered. Obviously, in sandy soil, the pole depth would need be more than 20% of its length, while in extremely hard rocky soil, the pole depth may be less than 20% of its length.

It is apparent that the method of placing a sleeve around the utility pole is a preferred method since, in most cases, it is much more economical than pole replacement, and doesn't suffer from the problems which are going to be incurred again where a piggy-back pole into the ground arrangement is utilized. In most cases, the sleeve is made from steel, and can be precoated with a rust inhibitor in order that it lasts for a long period of time. However, the sleeve method may be costly if the annulus around the utility pole has to be evacuated by hand methods. If it were possible to utilize the sleeve itself as a tool for evacuating the annulus of soil between the pole and the sleeve, the benefit is obvious. It is to such a split sleeve, which will evacuate an annulus of soil around a standing utility pole, the subject invention is directed.

SUMMARY OF THE INVENTION

The present invention defines a split apart or two piece sleeve adapted to surround a standing utility (telephone, power, or other) pole which, when the sleeve is rotated, will work its way down around the pole and excavate the dirt from between the telephone pole and the sleeve in some manner in order that the annulus of soil excavated may be filled in with a mixture adapted to preserve the utility pole, and to rigidly hold the utility pole within the sleeve; the pole, material filler, and sleeve bonded into a single structure with a strength surpassing the original pole.

More specifically, the present invention describes a split sleeve with a drilling tip so designed as to provide means such as excavating doors or flaps whereby soil is moved from the annulus between the telephone pole and the inner diameter of the sleeve to the outside of the sleeve and compacted into the earth immediately surrounding the outside of the sleeve.

To accomplish the objectives of the soil excavating sleeve, an elongated hollow cylindrical sleeve is constructed from two half rounded steel plates bolted together, one end of the steel plates being serrated with teeth, the teeth adapted to engage the ground and cut through it, and, in one corner of the steel plates, a cut or slot is made to form an excavating door or flap which is then turned inward after the plates are assembled into a sleeve, the excavating flap adapted to engage the soil between the utility pole and the interior of the sleeve and excavate that soil to the outside of the sleeve and compact it into the earth surrounding the sleeve. A rider bar is welded across the excavation door or flap to provide structural strength to the excavating door or flap and hold it in place, to ride against the utility pole to space the excavating flap from the pole in order that the utility pole will not be gouged or chewed up by the leading edge of the excavating flat, and, to keep the sleeve rotating centrally around the utility pole.

The distance the flap is bent inward is determined by measuring the diameter of the utility pole, and then using a standard sized sleeve, bending the flap inward a distance of the calculated annulus thickness. The flat may be bent with a wrench or other tool, or it may be struck with sledge hammers until the proper bending is accomplished. Such bending may be done either before or after the sleeve is assembled. After the flap is bent, the rider bar is welded across the flap.

The sleeve is assembled around the standing utility pole in an above ground position by bringing the two half-rounded sections together and bolting them together. At that time, the unattached end of the rider bar is welded to the opposite side of the sleeve. While for safety the pole is held stationary at a point 8 to 10 feet above ground, the sleeve is then engaged by a mechanical rotation device which rotates the sleeve around the standing utility pole while at the same time applying downward force to the sleeve. The teeth of the sleeve cut into the ground around the utility pole, breaking it up, and the door or excavating flap interiorly to the sleeve moves the soil in the annulus between the pole and the sleeve to the outside of the sleeve, compacting it into the surrounding earth. Normally the sleeve is rotated around and driven down until ½ of the sleeve is below the ground and ½ above the ground, and with standard size sleeves of 6 or 7 feet, the ground is at the 3 to 3½ foot point in the sleeve. The sleeve, having compacted earth about it, is firmly held in the ground. Thereafter, a mixture of epoxy, aggragate, resin, and fungicide is poured into the annulus and allowed to harden and bond the steel sleeve, the filling mixture, and the utility pole into a single structure, thus restoring the ground line strength of the utility pole.

It is an object of the subject invention to provide a sleeve which, through rotation, can excavate soil interiorly to the sleeve.

It is another object of the subject invention to provide a sleeve which, when rotated about a standing utility pole, will excavate an annulus of soil between the utility pole and the interior of the sleeve.

It is still another object of the subject invention to provide a sleeve adapted to surround a utility pole which evacuates the annulus of soil between the pole and the sleeve and which will remain in place to provide structural integrity to the utility pole.

Other objects of the invention will in part be obvious and will in part appear hereinafter. The invention accordingly comprises the construction and method of construction combining the elements and arranging the parts which are exemplified in the following detailed disclosure and the scope of the application of which will be indicated in the claims.

BRIEF DESCRIPTION OF THE DRAWINGS

For further understanding of the nature and objects of the subject invention, reference should be had to the following detailed description taken in connection with the accompanying drawings wherein.

In the various views, like index numbers refer to like elements.

DETAILED DESCRIPTION OF THE PREFERRED EMBODIMENT

Figure 1:
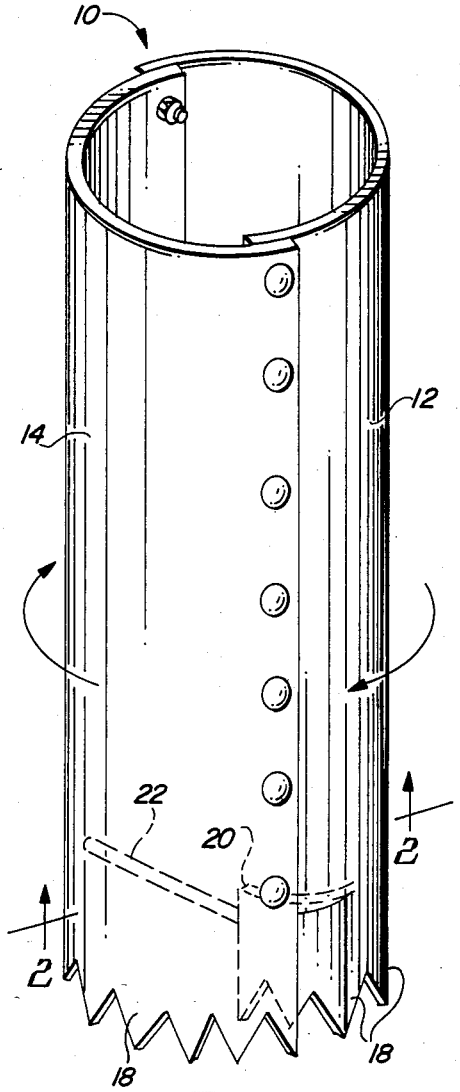
FIG. 1 is a perspective view of the subject inventive soil excavating sleeve.

Referring now to FIG. 1, a perspective view of the subject inventive sleeve which excavates soil to form an evacuated annulus about a utility pole and then is used to secure the pole is shown. The sleeve 10 is constructed from two elongated half-rounded steel plates 12 and 14 held together as an elongated hollow cylindrical sleeve by a plurality of bolts 16 which join each of the sides to the other half-round steel plate side. The bottom end of the inventive sleeve 10 is characterized by the drilling tip, i.e., a plurality of serrated teeth 18 and one corner of each steel plate 12 and 14 bent interiorly to the cylindrical sleeve to form excavating door or flap 20 (shown in FIG. 1 in dotted lines). Welded to the inside face of door 20 is rider bar 22 (dotted lines) which extends to a point on the steel plate opposite the end of door 20 and is attached there by welding.

Figure 2:
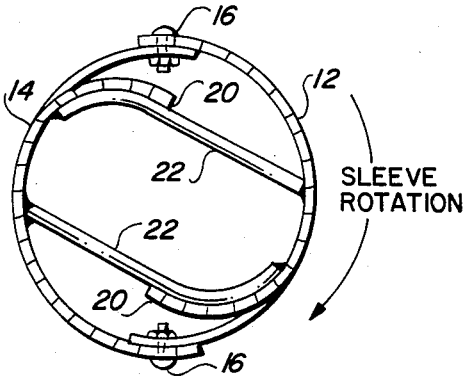
FIG. 2 is an end view of the subject inventive soil excavating sleeve.

In FIG. 2, a bottom end view is shown looking into the excavating sleeve. Detailed in the end view of the circular sleeve is firstly the two steel plates 12 and 14 comprising cylindrical wall of sleeve 10, bolts 16 on opposite sides of sleeve 10 holding the two plates together, the pair of excavating doors or flaps 20, one of which is formed in each of the steel plates 12 and 14, and finally rider bar 22 attached at one of its ends to door 20 with the other end attached to the other steel plate at a point opposite the end of the door 20. Rider bar 22 is preferably attached by welding at each end, and then at one or two points along door or excavating flap. Rider bar 22 is a short piece of ½ inch reinforcing steel bar. Also shown in FIG. 2 is a circular arrow with the notation "sleeve rotation" which indicates the direction which the sleeve rotates to excavate the annulus of dirt from around the telephone pole.

Figure 3:
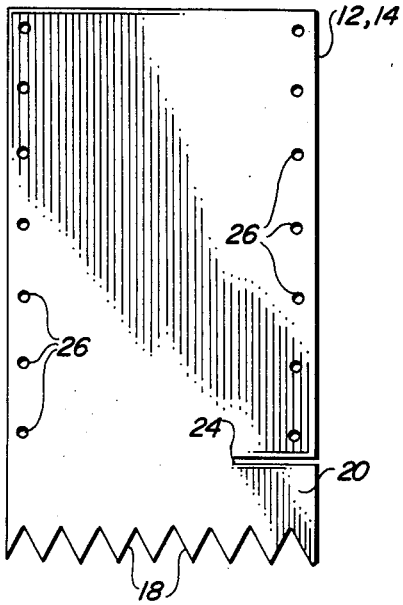
FIG. 3 is a top view of one of the flat steel plates which comprises ½ of the subject inventive soil excavating sleeve.

FIG. 3 shows a top view of plate 12 or 14 (since they are identical) prior to the plate being rolled into a half-round section. Steel plate 12 starts out as flat stock in the preferred embodiment having a thickness of 0.19 inches, and is cut to shape, drilled, and teeth cut while laying flat. Excavating door or flap 20 is formed in the lower right hand corner by means of cut or slot 24 which is made through steel plate 12 by sawing or by a cutting torch. Holes 26 are cut or drilled into plate 12 to receive the plurality of bolts 16 which hold the two plates together after they have been formed into the half-round sections. As it can be seen from FIGS. 1 and 3, the bolts at the upper portion of sleeve 10 are greater in size than the bolts which are used in the lower portion. One reason for this, as discussed later, is that the upper two holes are adapted to be engaged by the device which rotates the sleeve to excavate the annulus and larger holes provide an easier means of holding the sleeve during the earth excavation process.

In operation, the inventive sleeve 10 is used as follows. After the utility pole has been selected about which the inventive strengthening sleeve is to be emplaced, debris is first cleaned from around the pole at the ground level. Then the diameter of the pole at the ground level is measured and recorded. Since the preferred annulus of dirt excavated from around the pole is to be in a thickness of approximately 2½ to 3 inches, the diameter of the sleeve to be used is determined by adding the diameter of the pole to twice the selected thickness of the annulus. Since the sleeves are constructed in a selection of predetermined sizes, the appropriate sleeve is selected. For example, if the pole has a diameter at the ground level of 12 inches, and an annulus thickness of 2½ inches is utilized, the diameter of the sleeve is to be in the order of 17 inches. The next largest standard diameter sleeve is 18 inches (inside dimensions), so such sleeve is selected. Since the diameter of the pole is known, i.e., 12 inches, and the diameter of the sleeve is to be 18 inches, the annulus thickness will be 3 inches on either side of the pole. Accordingly, the excavating door or flap 22 is bent interiorly to the sleeve a distance of 3 inches. Following that, rider bar 22 is welded to the sleeve and the flap with approximately ½ the bar touching the inside of the flap and ½ of the bar extending beyond the end of the excavating flap. It is suggested that the bar in the area of the flap be bent slightly to conform with the roundness of the flap and that the bar be placed at a point just immediately above the teeth formed in the steel plate.

In utilizing the above example, it is realized that with a ½ inch thick rider bar 22, the distance between the opposite rider bars is approximately 1 inch less than the diameter of the utility pole. By using this method, the operator is assured that the outside layer of decayed wood of the utility pole will be scraped off by the rider bar and thus a more substantial surface of the utility pole is presented to be held by the filler mixture placed in the annulus between the pole and the sleeve. In addition, it has been found that there is sufficient springing of the rider bar and excavating flap that the strong wood underneath the outside decayed layer of the utility pole will urge the rider bar and excavating flap outwardly so that a full ½ inch of the outside of the utility pole is not removed unless it is totally decayed wood.

The preparation of the excavating flap and attaching rider bar is accomplished on both the steel plates 12 and 14, the plates being disassembled at this time although they have been previously formed into their half rounded section shape.

Since the plates 12 and 14 arrive in the field already rolled into a half round section and with holes predrilled, ready to be bolted together, the sleeve may be easily constructed. Accordingly, the sleeve is assembled about the vertically standing utility pole. For safety, it is suggested that the utility pole be securely held at a point 8 to 10 feet above the ground level. The mechanical device which rotates the sleeve may be adapted to accomplish such a matter. To assemble the sleeve, the two half round section plates are brought together with the bolt holes in alignment to form a completed cylindrical sleeve with the excavating flaps opposite each other. Bolts are inserted into all holes except the top two aligned holes. In the preferred embodiment, self-tapping ⅜th. inch bolts are used for the lower bolts, which require no nut since the bolt will form its own thread in the inside plate. For the upper two bolt holes, ⅝th. or ¾ qtr. inch bolts are employed, however, their placement is held off for a while.

Once the sleeve has been constructed by fixedly attaching the two half round section plates together, the sleeve is raised and a workman, using a welder, welds the previously unattached end of the rider bar to the steel plate opposite the end of the excavating flap. Since the sleeve is fairly large, and the rider bar near the teeth end of the sleeve, it is possible for a welder to reach up into the sleeve and weld the rider bar to the plate. This firmly secures the rider bar.

At this point, construction of the sleeve is complete and the next task is to rotate the sleeve into the ground, utilizing a downward rotating force, and thus excavate an annulus of earth from the outside of the utility pole. While it is noted that generally the utility pole diameter will increase as the depth of the pole in the ground increases, it has been found that there is sufficient flexibility in the rider bar and the excavating flap so that the diameter of the pole will slightly bend the rider bar outward and thus move the excavating flap out as drilling and rotation of the sleeve in the ground progresses. Purposes of the rider bar are to keep the sleeve centered around the utility pole and to keep the doors or excavating flaps from digging into the utility pole and chipping it away. In addition, rider bar 22 provides holding strength to the excavating flap 20 to keep it rigid with respect to the sleeve 10.

If the condition of the pole underground is known to be in good condition, it is not necessary that the rider bar be held forcibly against the pole in which case the excavating flap is bent inward the distance previously calculated less ½ inch. This allows the bar to just touch the pole, at least at the top of the ground. It will begin to tighten against the pole as the sleeve progresses downward since the diameter of most wooden poles increase with depth.

The method by which the sleeve is rotated in the ground is optional, however, the Applicant has devised a rotary drive which engages the sleeve on opposite sides at the points of the upper two bolt holes, and through a split gear ring concentric to the sleeve, mechanically rotates the sleeve about the utility pole while at the same time applying downward pressure. The sleeve, rotating in the direction shown in FIG. 2, has its teeth engaging the earth to break and crumble the earth 3 inches or so from the outside of the utility pole. The excavating flap, engaging the earth between the utility pole and the inside diameter of the sleeve, forces the soil out the passageway formed by the excavating flap and the plate opposite and compacts the soil into the earth immediately outside the sleeve exterior. The inventive sleeve does not bring soil up to the top for removal, however, it merely compresses the soil into the existing earth surrounding the sleeve.

The process of applying downward pressure while rotating the sleeve, excavating the dirt to the peripheral portion of the sleeve and compacting it into the earth at that point continues until approximately ½ the sleeve is buried below the surface of the ground and ½ the sleeve is above the surface of the ground. At this point, the rotating means which rotates the sleeve and applies the downward pressure is removed and, still holding the pole at a point above the sleeve so that the pole will not lean or break, the two upper bolts are inserted in the matching holes at the upper portion of the sleeve holding the sleeve together, and nuts attached on the inside.

That being accomplished, a mixture of epoxy, aggregate, resin and fungicide is placed into the excavated annulus between the outside of the utility pole and the inside of sleeve 10 and allowed to set and harden. Once the added mixture has hardened, the utility pole upper support is removed. The steel sleeve, filler, and pole are now a single structure having a strength greater than existed when the pole was new. At this time, installation of sleeve reinforcing the utility pole is complete and the sleeve is left in place for the remainder of the pole life. It is suggested that the sleeve, prior to installation, be painted with an oxidation resistant paint so as to inhibit rust on the outside.

In the usual circumstance, the sleeves are either 6 or 7 feet long, and in such cases, approximately 3 to 3½ feet of the sleeve is above ground and the same length below ground.

Now there are instances where, due to the condition of the pole and/or the surrounding earth, it may be advantageous to emplace the sleeve at a much greater distance below ground than the nominal 3 to 3½ feet. In such cases, the standard sleeve is emplaced into the ground its total length and in doing so, excavates the soil from around the utility pole into the earth surrounding the sleeve for the full depth of the length of the sleeve. When that is accomplished, the sleeve rotating mechanism is removed and a second sleeve of the same size is butt-welded to the top of the first sleeve. For such occasion, the teeth normally found in the standard sleeve are not cut in the supplementary sleeve in order that a complete weld may be accomplished. The weld is made all around the butt-joinder of the two sleeves so that in effect, you have one sleeve of double length. The combined sleeves are then filled with the appropriate mixture, which sets and hardens and securely holds the utility pole in place in the earth. It is obvious also that a longer than standard sleeve may be constructed and used.

Applicant has designed a group of standard sized sleeves.for use in most all common utility poles and in Table 1. following, the dimensions of the standard formed sleeves are set out. All dimensions are in inches. The A-width is the width of the flat steel plate. C slot is the length of the cut made in the steel plate to form the excavating door or flap 20. The E radius is the inside diameter radius of the half round steel plates after they have been formed into a half circle. It is noted that the width is greater than ½ circle, it being greater so that the plate, after forming into a half circle, has an overlapping portion on both sides adapted to receive the holes for the connecting bolts, the overlapping portion generally being 3 inches wide. This can be seen in the drawings.

TABLE 1

| Sleeve Diameter | A Width | C Slot | E Radius |
|---|---|---|---|
| 16 | 28.50 | 8.00 | 8.00 |
| 18 | 31.62 | 8.75 | 9.00 |
| 20 | 34.69 | 9.75 | 10.00 |
| 22 | 38.00 | 10.75 | 11.00 |
| 24 | 41.00 | 11.50 | 12.00 |
| 26 | 44.25 | 12.50 | 13.00 |
| 28 | 47.38 | 13.25 | 14.00 |

Figure 4:
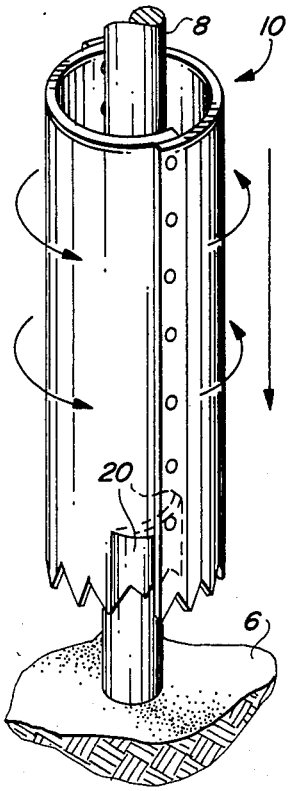
FIG. 4 is a perspective view of the subject inventive soil excavating sleeve around a utility pole prior to emplacement into the ground.

FIG. 4 shows a perspective view of the subject inventive soil excavating sleeve 10 surround a utility pole 8 ready to engage the earth ground 6 for ultimate permanent placement into the ground. In FIG. 4, the sleeve has been fully assembled with both plates bolted together.

Figure 5:
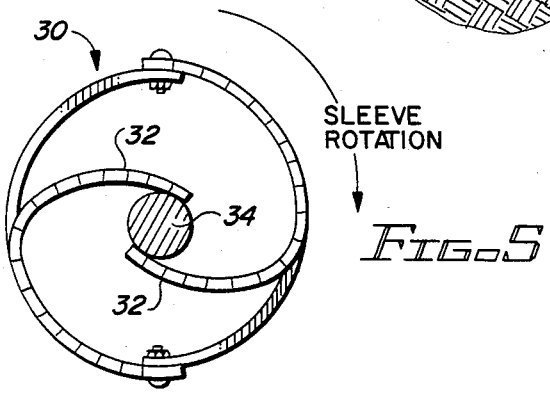
FIG. 5 is an end view of an alternate embodiment of an inventive soil excavating sleeve.
Figure 6:
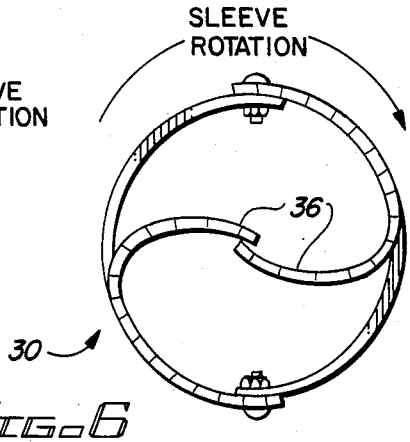
FIG. 6 is an end view of the alternate embodiment for excavating a complete cylinder.

An alternate embodiment of the subject invention is shown in FIG. 5 wherein an end view is shown of a modified sleeve 30 where the doors or excavating flaps 32 have been turned in to almost the center of the sleeve. In this embodiment, the sleeve will excavate all the soil from the center of the sleeve to the earth surrounding the sleeve. In the embodiment shown in FIG. 5, there would be a small core of earth left in the center of the sleeve, however, that would, as the sleeve progresses downward in the earth, collapse and thus also be excavated to the side. In the event that the very small diameter core 34 did not fall over of its own, it could be knocked over from above with a stick into the path of the excavating flaps 32 since access into the center of the sleeve is possible from above while the sleeve is rotating. It is even conceivable to have the excavating flaps touching in the center and this excavates the total center of the sleeve without any core. This can be seen in FIG. 6 where core 34 has been reduced to a zero diameter. FIG. 6 shows excavating flaps 36 in sleeve 30 now extending to the center where each one will sweep out the entire center area of the sleeve.

It is obvious that there will be a limit to the diameter of the hole which may be excavated in the alternate embodiment, and that limit would be reached as the soil being excavated resists compacting in the earth surrounding the sleeve 30 and power requirements exceed the power available for rotating and pressing downward of the sleeve. Obviously, the efficiency of sleeve 30 will depend to a large extent upon the type of soil in which the sleeve is placed. Soil which is already tightly compacted will offer the most resistance to the excavating sleeve while sandy soil will provide the least resistance.

Figure 7:
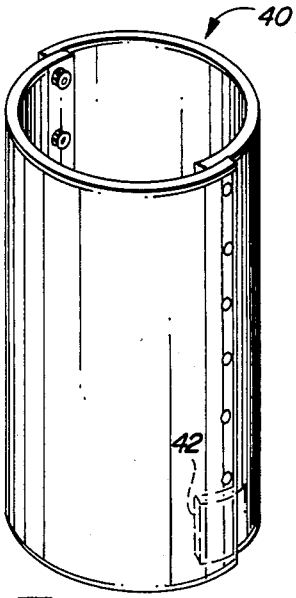
FIG. 7 is a perspective view of a second alternate embodiment of an inventive soil excavating sleeve.

It has been determined that the inventive soil excavating sleeve will also operate in the absence of teeth. FIG. 7 shows such a sleeve. Here, sleeve 40 still possesses excavating door or flap 42 which works identically to flap 20 shown in FIGS. 1–4. The power requirements to rotate and press downward sleeve 40 are increased over that of sleeve 10, and sleeve 40 is not as fast or as efficient.

It is realized that the subject invention may be utilized on many other different types of poles or posts, for example, piles used to support structures and the like.

While a preferred embodiment of Applicant's invention has been shown and described, together with alternate embodiments, it is appreciated that such other embodiments of the invention are possible and that there is no intent to limit the invention by such disclosure, but, rather it is intended to cover all modifications and alternate embodiments falling within the spirit and the scope of the invention as defined by the appended claims.

We claim:

1. A soil excavating and utility pole securing sleeve comprising:

an elongated hollow cylinder adapted to surround a standing utility pole, said cylinder having two circular ends and inside and outside cylindrical surfaces; and a soil engaging excavating flap operably attached to said cylindrical surfaces and situated at a first end of said elongated hollow cylinder, said excavating flap adapted to engage the soil interiorly to said cylinder and move the soil outside the cylinder when said sleeve is rotated and thereby form an evacuated annulus between the utility pole and said cylinder.

2. The soil excavating and utility pole securing sleeve as defined in claim 1 wherein said excavating flap defines an inwardly bent portion of said elongated hollow cylinder formed by partially cutting a door in said cylinder and bending said door inwardly to said cylinder whereby said excavating flap moves soil out of said cylinder proximate said cylinder first end and into the surrounding earth when said sleeve is rotated.

3. The soil excavating and utility pole securing sleeve as defined in claim 2 further including a plurality of serrated teeth on said first end of said elongated hollow cylinder, said teeth adapted to engage the soil and break it up as said sleeve is rotated.

4. The soil excavating and utility pole securing sleeve as defined in claim 3 further including a rider bar, said rider bar secured interiorly to said cylinder by attaching to said excavating flap and to said cylinder interior at a point opposite said inwardly directed excavating flap.

5. The soil excavating and utility pole securing sleeve as defined in claim 3 wherein said excavating flap is bent inward a distance equal to the desired thickness of the evacuated annulus between the utility pole and the cylinder.

6. The soil excavating and utility pole securing sleeve as defined in claim 3 wherein said elongated hollow cylinder comprises two half round steel plates adapted to surround a utility pole and to be fixedly held together thereafter.

7. The soil excavating and utility pole securing sleeve as defined in claim 3 wherein said excavating flap additionally includes serrated teeth adapted to engage the soil interiorly to said cylinder and break it up as said sleeve is rotated.

8. The soil excavating and utility pole securing sleeve as defined in claim 7 further including a plurality of excavating flaps formed at said first end of said elongated hollow cylinder.

9. The soil excavating and utility pole securing sleeve as defined in claim 3 wherein said cylinder second end is adapted to be engaged by means rotating said sleeve.

10. The soil excavating and utility pole securing sleeve as defined in claim 3 further including filling mixture to be placed in the evacuated annulus between the utility pole and the cylinder, said filling mixture comprising epoxy, resin, fungicide, and aggragate which, when cured and hardened, combines to make the utility pole, filling mixture, and cylinder become one single structure.

11. A soil excavating sleeve comprising:

an elongated hollow cylinder, said cylinder having two circular ends and inside and outside cylindrical surfaces; and a soil engaging excavating flap operably attached to said cylindrical surfaces and situated at a first end of said elongated hollow cylinder, said excavating flap adapted to engage the soil interiorly to said cylinder and move the soil outside the cylinder when said sleeve is rotated and thereby evacuate the volume interiorly of said cylinder.

12. The soil excavating sleeve as defined in claim 11 wherein said excavating flap defines an inwardly bent portion of said elongated hollow cylinder formed by partially cutting a door in said cylinder and bending said door inwardly to said cylinder whereby said excavating flap moves soil out of said cylinder proximate said cylinder first end and into the surrounding earth when said sleeve is rotated.

13. The soil excavating sleeve as defined in claim 12 further including a plurality of serrated teeth on said first end of said elongated hollow cylinder, said teeth adapted to engage the soil and break it up as said sleeve is rotated.

14. The soil excavating sleeve as defined in claim 13 further including a rider bar, said rider bar secured interiorly to said cylinder by attaching to said excavating flap and to said cylinder interior at a point opposite said inwardly directed excavating flap.

15. The soil excavating sleeve as defined in claim 13 wherein said excavating flap is bent inward to the center of the cylinder.

16. The soil excavating sleeve as defined in claim 13 wherein said elongated hollow cylinder comprises two half round steel plates adapted to be fixedly held together thereafter.

17. The soil excavating sleeve as defined in claim 13 wherein said excavating flap additionally includes serrated teeth adapted to engage the soil interiorly to said cylinder and break it up as said sleeve is rotated.

18. the soil excavating sleeve as defined in claim 17 further including a plurality of excavating flaps formed at said first end of said elongated hollow cylinder.

19. The soil excavating sleeve as defined in claim 13 wherein said cylinder second end is adapted to be engaged by means rotating said sleeve.

* * * * *